US006768074B2

(12) United States Patent
Iwama

(10) Patent No.: US 6,768,074 B2
(45) Date of Patent: Jul. 27, 2004

(54) EASILY PEELABLE SHEET HAVING CONTACT PLATES AND SWITCH DEVICE EMPLOYING THE SAME

(75) Inventor: Naoya Iwama, Miyagi-ken (JP)

(73) Assignee: ALPS Electric Co., Ltd., Tokyo (JP)

( * ) Notice: Subject to any disclaimer, the term of this patent is extended or adjusted under 35 U.S.C. 154(b) by 62 days.

(21) Appl. No.: 10/060,832

(22) Filed: Jan. 29, 2002

(65) Prior Publication Data

US 2002/0125578 A1 Sep. 12, 2002

(30) Foreign Application Priority Data

Mar. 8, 2001 (JP) ..... 2001-065778

(51) Int. Cl.[7] ..... H01H 13/48
(52) U.S. Cl. ..... 200/515; 200/516
(58) Field of Search ..... 200/515, 516, 200/512; 29/622

(56) References Cited

U.S. PATENT DOCUMENTS 4,046,975 A * 9/1977 Seeger, Jr. ..... 200/515
4,931,601 A * 6/1990 Lavender ..... 200/515
5,845,766 A 12/1998 Sako et al.

FOREIGN PATENT DOCUMENTS

JP 11-53084 2/1999

* cited by examiner

*Primary Examiner*—Renee Luebke
(74) *Attorney, Agent, or Firm*—Beyer Weaver & Thomas, LLP

(57) ABSTRACT

A sheet having contact plates includes a strip-shaped peel sheet that is peeled while being fed for use, a spacer sheet stuck onto the peel sheet via an adhesive layer, an upper face sheet stuck onto an upper face of the spacer sheet via an adhesive layer, and contact plates stuck to the upper face sheet. The peel sheet and the spacer sheet are provided with penetration holes through which the contact plates can penetrate, and coupling grooves by which the adjacent penetration holes are coupled in a direction crossing a feed direction of the peel sheet. The coupling grooves are shifted at one side in the widthwise direction thereof to rear ends in the feed direction of inner circumferences of the adjacent penetration holes so that there are no protrusions protruding in the feed direction from the rear ends of the inner circumferences of the adjacent penetration holes.

6 Claims, 4 Drawing Sheets

EASILY PEELABLE SHEET HAVING CONTACT PLATES AND SWITCH DEVICE EMPLOYING THE SAME

BACKGROUND OF THE INVENTION

1. Field of the Invention

The present invention relates to a sheet having contact plates used as a key switch for operating digital communication equipment such as portable phones, and the structure of a switch employing the same.

2. Description of the Prior Art

The structure of a conventional switch sheet is shown in FIGS. 6 to 8. FIG. 6 is an exploded perspective view showing the switch sheet. FIG. 7 is a plan view showing details of penetration holes. FIG. 8 is a side view of FIG. 7.

A conventional switch sheet comprises: a peel sheet 11 formed into a strip shape and having feed guide holes 11*a* provided at a fixed interval at both sides of a longitudinal direction X (feed direction); a rectangular spacer sheet 13 stuck to a separate face of the peel sheet 11 via an adhesive layer; and a rectangular upper face sheet 14 stuck to an upper face of the spacer sheet 13 via an adhesive layer.

On the peel sheet 11 and the spacer sheet 13, plural penetration holes 13*a* are formed which penetrate contact plates formed by expanding thin metal plates in a dome shape and make it possible to stick the dome tops of the contact plates to a lower face of the upper face sheet 14 via an adhesive layer. Coupling grooves 13*b* and 13*c* are provided to couple adjacent penetration holes 13*a* of the plural penetration holes 13*a*.

The coupling grooves 13*b* and 13*c* are provided at about the center of the penetration holes 13*a*. By providing the coupling grooves 13*b* and 13*c*, when the dome-shaped contact plates are pushed, air within the domes can be expelled to other penetration holes 13*a* through the coupling grooves 13*b* and 13*c*, providing stable operability.

The coupling grooves 13*b* and 13*c* are formed from vertical coupling grooves 13*c* formed along the longitudinal direction X (feed direction) of the peel sheet 11 and the spacer sheet 13, and horizontal coupling grooves 13*b* formed along a direction Y crossing the longitudinal direction (feed direction).

However, in the structure of the above-described conventional switch sheet, the switch sheet is mounted on a circuit board in such a way that, while pulling out the stripe-shaped peel sheet 11 in the feed direction X, the peel sheet 11 is peeled off with the spacer sheet 13 and the upper face sheet 14 being overlaid, and the separated spacer sheet 13 and upper face sheet 14 are stuck onto the circuit board.

In this case, as shown in FIGS. 7 and 8, in the conventional switch sheet, since the coupling grooves 13*b* and 13*c* are formed at about the center of the penetration holes 13*a*, at both sides of the coupling grooves 13*b* and 13*c*, protrusions 13*d* exist toward a coupling part from an inner circumferential end of the penetration holes 13*a*. In the case where the coupling grooves 13*b* and 13*c* are formed in the direction Y crossing the longitudinal direction X (feed direction) of the peel sheet 11, since the protrusions 13*d* on a peel face between the spacer sheet 13 and the peel sheet 11 protrude from an inner circumferential end of the penetration holes 13*a*, the protrusions 13*d* remain unpeeled, so that it is difficult to peel the peel sheet 11 from the spacer sheet 13 in the vicinity of the protrusions 13. This has been a problem of the conventional switch sheet.

In the case where all the coupling grooves 13*b* and 13*c* are formed along the longitudinal direction X (feed direction) of the peel sheet 11, the position of the penetration holes 13*a*, that is, the layout of contact plates is limited. This has been another problem of the conventional switch sheet.

SUMMARY OF THE INVENTION

The present invention solves the above-described problems and provides a sheet having contact plates that allows a peel sheet thereof to be smoothly peeled from a spacer sheet and provides greater freedom in the layout of the contact plates, and a switch device employing the same.

To solve the above-described problems, a first embodiment of a sheet according to the present invention includes a strip-shaped peel sheet; a spacer sheet stuck onto the peel sheet via an adhesive layer; an upper face sheet stuck onto an upper face of the spacer sheet via an adhesive layer; and contact plates stuck to the upper face sheet. On the peel sheet and the spacer sheet, penetration holes through which the contact plates can penetrate, and coupling grooves by which the adjacent penetration holes are coupled are formed. The peel sheet is peeled off from a downstream end toward an upstream end of the peel sheet. Each of the coupling grooves has an upstream edge and a downstream edge where the upstream edge is positioned upstream with respect to the downstream edge. The coupling grooves are displaced toward the upstream end in the feed direction with respect to a center of each of the adjacent penetration holes so that there are no upstream edges within a plane of the spacer sheet, protruding toward the downstream end in the feed direction.

In a second embodiment of the invention, one side of the coupling grooves continues linearly or curvedly.

In a third embodiment of the invention, a coupling part at another side of the coupling grooves coupling the penetration holes is formed in an arc shape.

In a fourth embodiment of the invention, the spacer sheet and the upper face sheet are formed rectangularly and are mounted so that short sides of the rectangles are in the feed direction of the strip-shaped peel sheet, and wherein the penetration holes disposed at a side of a long side of the spacer sheet are coupled by the coupling grooves.

In a fifth embodiment of the invention, the coupling grooves are formed from first coupling grooves coupling the penetration holes disposed at the side of the long side of the spacer sheet and second coupling grooves coupling the penetration holes disposed at a side of the short side of the spacer sheet.

In a sixth embodiment of the invention, a sheet having contact plates including one of the first to fifth embodiments of the invention and a circuit board on which plural fixed contacts are disposed are provided. A peel sheet of the sheet having contact plates is peeled, and the sheet having the contact plates from which the peel sheet has been peeled is stuck onto the circuit board on which plural fixed contacts are disposed, by an adhesive layer of the spacer sheet so that the contact plates are opposite to the fixed contacts.

BRIEF DESCRIPTION OF THE DRAWINGS

Preferred embodiments of the present invention will be described in detail based on the followings, wherein.

DESCRIPTION OF THE PREFERRED EMBODIMENTS

Figure 1:
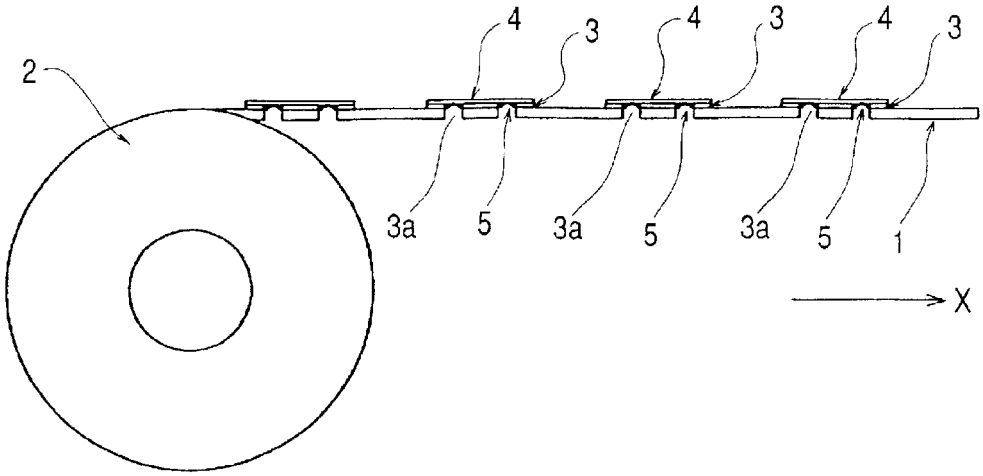
FIG. 1 is a drawing showing a roll of a peel sheet of a sheet having contact plates according to one embodiment of the present invention.
Figure 2:
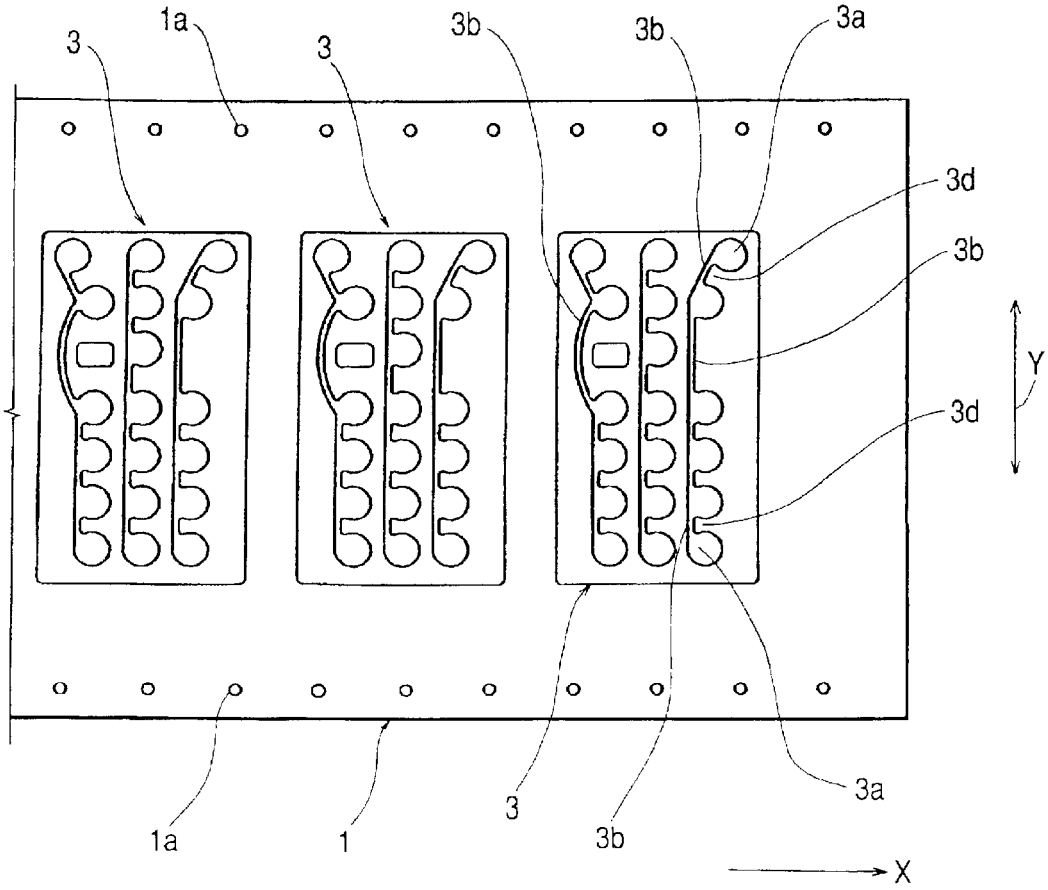
FIG. 2 is a plan view showing the sheet having contact plates of the present invention from which the peel sheet is removed.
Figure 3:
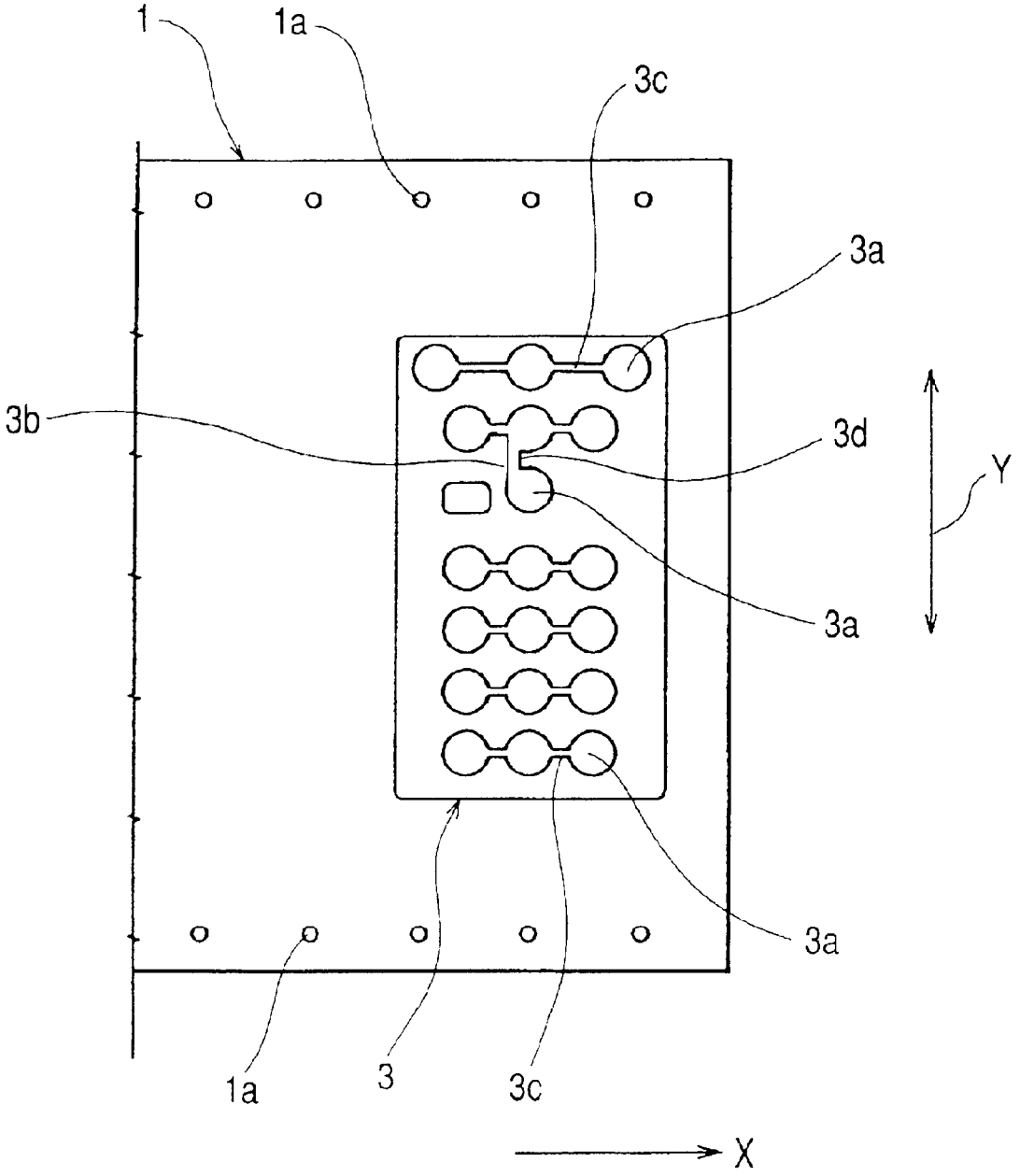
FIG. 3 is a plan view showing the sheet having contact plates of the present invention from which the peel sheet is removed.
Figure 4:
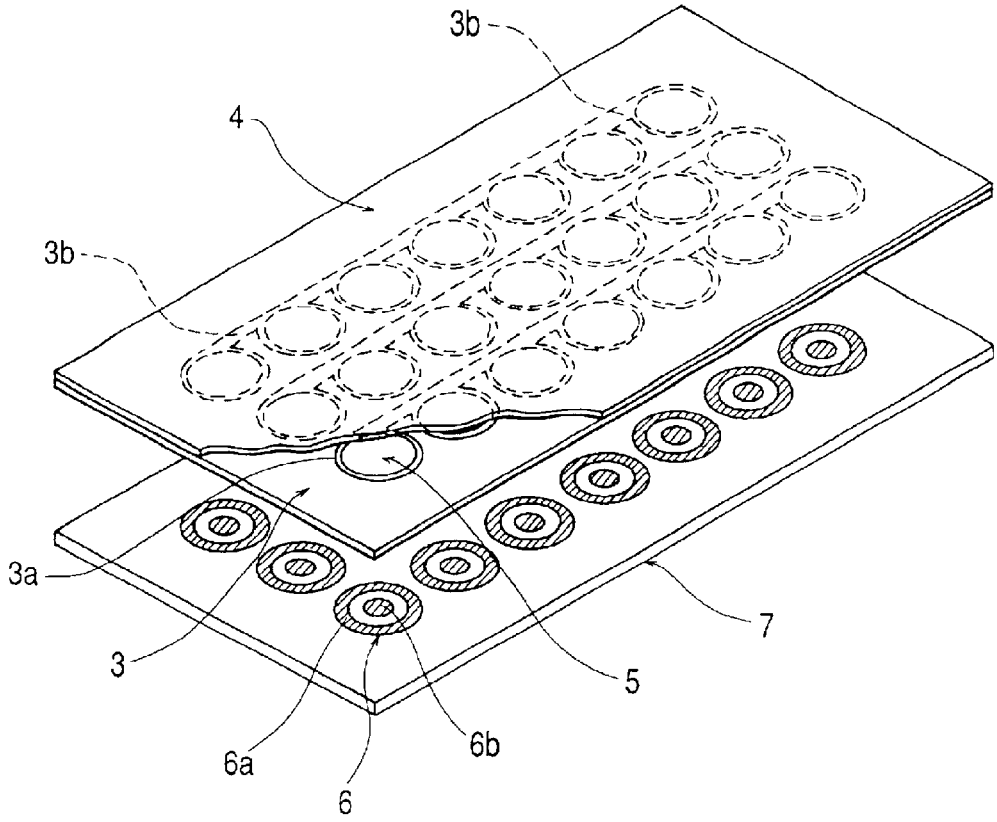
FIG. 4 is an exploded perspective view showing a switch device employing the sheet having contact plates of the present invention.
Figure 5:
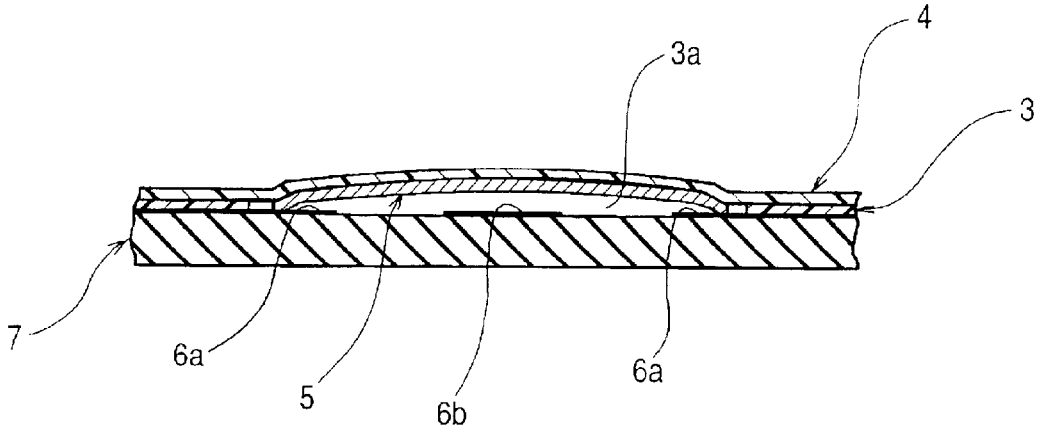
FIG. 5 is a partial sectional view showing the vicinity of a contact plate of the sheet having contact plates of the present invention.
Figure 6:
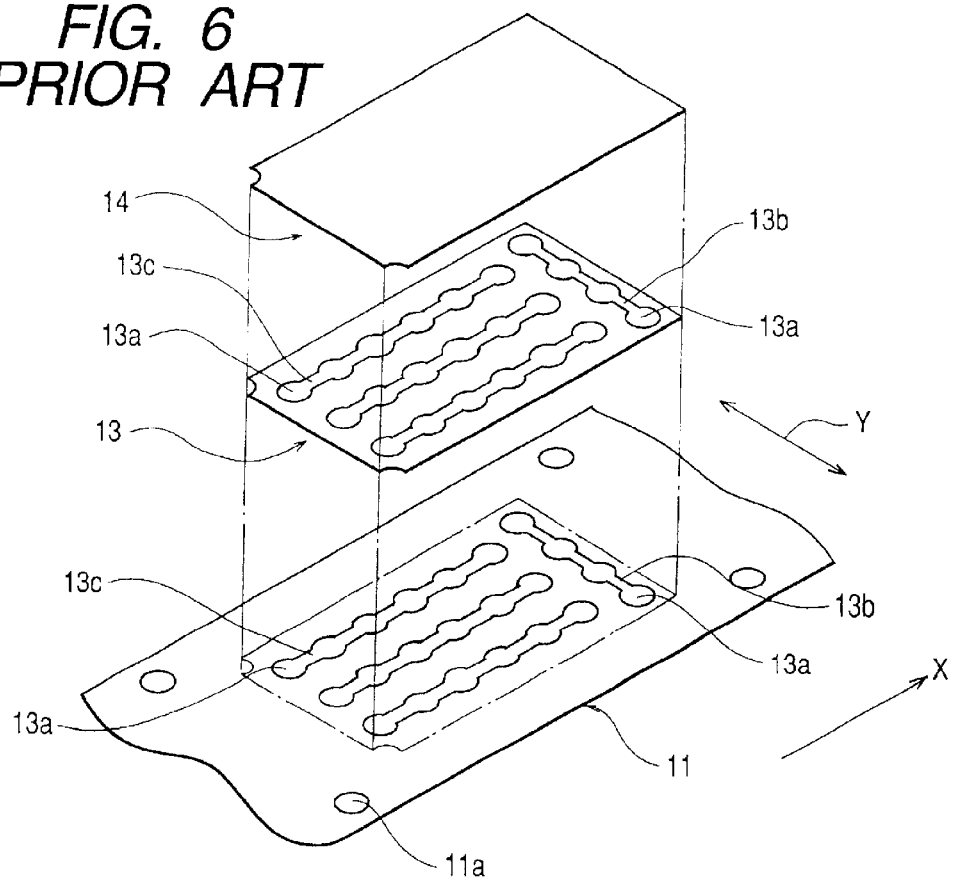
FIG. 6 PRIOR ART
FIG. 6 is an exploded perspective view showing a conventional switch sheet.
Figure 7:
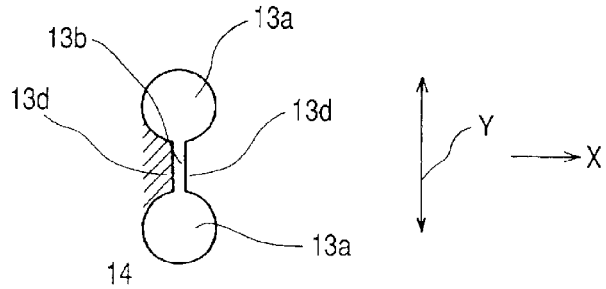
FIG. 7 PRIOR ART
FIG. 7 is a plan view showing partial details of penetration holes.
Figure 8:
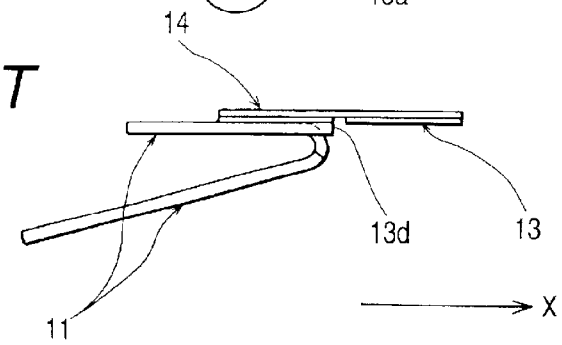
FIG. 8 PRIOR ART
FIG. 8 is a side view showing partial details of a penetration hole of a conventional switch sheet.

Hereinafter, one embodiment of the present invention is shown in FIGS. 1 to 5. FIG. 1 is a drawing showing a roll of a peel sheet of a sheet having contact plates. FIGS. 2 and 3 are plan views showing the sheet having contact plates from which the peel sheet is removed. FIG. 4 is an exploded perspective view showing a switch device employing a sheet having contact plates. FIG. 5 is a partial sectional view showing the vicinity of a contact plate of the same.

In FIGS. 1 to 3, the peel sheet 1 is formed in a strip shape with a thin resin sheet. In the peel sheet 1, feed guide holes 1*a* are continuously formed at a fixed interval at both sides along a longitudinal (feed) direction X, and the guide holes 1*a* are used as guide holes of pins for feeding a carriage sheet when the peel sheet 1 wound around a rotation reel 2 is removed by an automatic assembling machine or the like.

A rectangular spacer sheet 3 is stuck onto a separate face at the center of the peel sheet 1 via an adhesive layer. A rectangular upper face sheet 4 is stuck onto an upper face of the spacer sheet 3 via an adhesive layer. In this case, the spacer sheet 3 and the upper face sheet 4 are stuck so that the short side of the rectangles is in the longitudinal (feed) direction X of the strip-shaped peel sheet 1.

The spacer sheet 3 is formed rectangularly with a thin resin sheet. At the center of the spacer sheet 3, penetration holes 3*a* through which contact plates 5 described later can penetrate are formed as on the peel sheet 1. The penetration holes 3*a* are formed with plural coupling grooves 3*b* and 3*c* to couple adjacent penetration holes 3*a*. The coupling grooves 3*b* and 3*c* are formed from first coupling grooves 3*b* for coupling the penetration holes 3*a* disposed at the side of the long side of the spacer sheet 3, and coupling grooves 3*c* for coupling the penetration holes 3*a* disposed at the side of the short side of the spacer sheet 3.

FIG. 2 shows a case where only the first coupling grooves 3*b* of the coupling grooves 3*b* and 3*c* are formed in the peel sheet 1 and the spacer sheet 3, and FIG. 3 shows a case where both the first coupling grooves 3*b* and the second coupling grooves 3*c* are formed.

By providing the coupling grooves 3*b* and 3*c*, when dome-shaped contact plates 5 described later are pushed, air within the domes can be expelled to other penetration holes 3*a* through the coupling grooves 3*b* and 3*c*, providing stable switch operability.

Of the coupling grooves 3*b* and 3*c*, the second coupling grooves 3*c* provided along the longitudinal (feed) direction X of the stripe-shaped peel sheet 1 are formed at a center between adjacent penetration holes 3*a*, while the first coupling grooves 3*b* provided in a direction Y crossing the longitudinal (feed) direction X of the stripe-shaped peel sheet 1, without being formed at the center of the penetration holes 3*a*, are shifted so that one side thereof continues linearly or curvedly at the rear ends of the inner circumferences of the adjacent penetration holes 3*a* with respect to the longitudinal (feed) direction X of the peel sheet 1.

Although the coupling parts 3*d* at the other side of the first coupling grooves 3*b* for coupling the penetration holes 3*a* protrude from the inner circumferential end of the penetration holes 3*a*, the coupling parts 3*d* are also formed in such a manner that the peel sheet 1 can be easily peeled.

The contact plates 5 are formed by expanding conductive thin metal plates in a dome shape and inserted in penetration holes 3*a* of the peel sheet 1 and the spacer sheet 3, and their dome tops are stuck to the lower face of the upper sheet 4 via an adhesive layer. The sheet having contact plates is constructed with the plural contact plates 5 being held by the spacer sheet 3 and the upper face sheet 4.

FIGS. 4 and 5 show the structure of a switch device formed by sticking the sheet having contact plates peeled from the peel sheet 1 onto a circuit board 7 on which plural fixed contacts 6 are disposed, via an adhesive layer of the spacer sheet 3.

The circuit board 7 is formed from a multilayer plate such as insulative resin, and plural fixed contacts 6 constructed from copper foil, carbon, or the like are formed on the surface of the circuit board 7. The fixed contact 6 is formed from a ring-like peripheral contact 6*a* and a central contact 6*b* placed at the center of the peripheral contact 6*a* wherein a margin of the dome-shaped contact plate 5 contacts the peripheral contact 6*a* and the center of the dome faces the central contact 6*b*.

A description is made of a method of assembling the switch device employing the sheet having contact plates. As shown in FIG. 1, the sheet having contact plates wound around the rotation reel 2 is fed in the pull-out (feed) direction X of the peel sheet 1 along the guide holes 1*a* by a feeding mechanism such as an automatic machine not shown.

Next, the peel sheet 1 is wound up by a winding reel not shown, the spacer sheet 3 and the upper face sheet 4 by which the contact plates 5 are held are peeled from the peel sheet 1 and are stuck onto the circuit board 7 on which the plural fixed contacts 6 are disposed, via an adhesive layer of the spacer sheet 3. Thus, the switch device has been assembled.

At this time, the coupling grooves 3*b* and 3*c* coupling the penetration holes 3*a* provided on the peel sheet 1 and the spacer sheet 3 are formed by shifting one side of the first coupling grooves 3*b* provided in the direction Y crossing the longitudinal (feed) direction X of the strip-shaped peel sheet 1 to the rear ends of the inner circumferences of the adjacent penetration holes 3*a* with respect to the longitudinal (feed) direction X of the peel sheet 1, that is, by making continuous the ends of the penetration holes 3*a* that are opposite to the feed direction X. With this construction, there are no protrusions from the ends of the penetration holes 3*a* that are opposite to the feed direction X to the feed direction, and there are no peel remains caused by protrusions, so that the peel sheet 1 can be smoothly peeled. Since one side of the first coupling grooves 3*b* continues linearly or curvedly, the construction is simplified and peeling is further facilitated.

The spacer sheet 3 and the upper face sheet 4 are formed rectangularly and are mounted so that the short side of the rectangles is in the longitudinal (feed) direction X of the strip-shaped peel sheet 1, and the penetration holes 3*a* disposed at the side of the long side of the spacer sheet 3 are coupled by the first coupling grooves 3*b*. By this construction, the first coupling grooves 3*b* can be used as air expelling grooves, operability is increased, and a withdrawal (feed) amount required for peeling from the peel sheet 1 can be reduced. Consequently, operation efficiency is increased.

As shown in FIG. 3, the coupling grooves 3*b* and 3*c* are formed from the first coupling grooves 3*b* coupling the penetration holes 3*a* disposed at the side of the long side of the spacer sheet 3 and the second coupling grooves 3*c* coupling the penetration holes 3*a* disposed at the side of the short side of the spacer sheet 3, wherein the short side of the spacer sheet 3 is in the longitudinal (feed) direction X of the strip-shaped peel sheet 1. By this construction, there occur no peel remains in the second grooves 3*c*, so that the peel sheet can be smoothly peeled, and by combining the first and second coupling grooves 3*b* and 3*c*, the contact plates 5 can be laid out with greater freedom.

As shown in FIG. 2, since the first coupling grooves 3*b* may be formed in the direction Y crossing the withdrawal (feed) direction X of the strip-shaped peel sheet 1, for example, the first coupling grooves 3*b* may be formed slantingly with respect to the withdrawal (feed) direction X. Also, in this case, the peel sheet 1 can be smoothly peeled, so that the contact plates 5 can be laid out with greater freedom.

As has been described above, a sheet having contact plates of the present invention comprises: a strip-shaped peel sheet; a spacer sheet stuck onto the peel sheet via an adhesive layer; an upper face sheet stuck onto the upper face of the spacer sheet via an adhesive layer; and contact plates stuck to the upper face sheet, wherein, on the peel sheet and the spacer sheet, penetration holes through which the contact plates can penetrate, and coupling grooves by which the adjacent penetration holes are coupled are formed, wherein, of the coupling grooves, one side of the coupling grooves provided in a direction crossing a feed direction of the strip-shaped peel sheet continues to the rear ends of the inner circumferences of the adjacent penetration holes with respect to the feed direction of the peel sheet. With this construction, there are no protrusions from the ends of the penetration holes that are opposite to the feed direction to the feed direction, and there are no peel remains caused by protrusions, so that the peel sheet can be smoothly peeled.

Since one side of the coupling grooves continues linearly or curvedly, the construction is simplified and peeling is further facilitated.

Since a coupling part at another side of the coupling grooves coupling the penetration holes is formed in an arc shape, the peel sheet is easily peeled also in the coupling part protruding from the ends of the inner circumferences of the penetration holes.

The spacer sheet and the upper face sheet are formed rectangularly and are mounted so that the short side of the rectangles is in the feed direction of the strip-shaped peel sheet, and the penetration holes disposed at the side of the long side of the spacer sheet are coupled by the coupling grooves. By this construction, the coupling grooves can be used as air expelling grooves, operability is increased, and a withdrawal (feed) amount required for peeling from the peel sheet can be reduced. Consequently, operation efficiency is increased.

The coupling grooves are formed from first coupling grooves coupling the penetration holes disposed at the side of the long side of the spacer sheet and second coupling grooves coupling the penetration holes disposed at the side of the short side of the spacer sheet, wherein the short side of the spacer sheet is in the longitudinal (feed) direction of the strip-shaped peel sheet. By this construction, there occur no peel remains in the second grooves, so that the peel sheet can be smoothly peeled, and by combining the first and second coupling grooves, the contact plates can be laid out with greater freedom.

A sheet having contact plates and a circuit board on which plural fixed contacts are disposed are provided, a peel sheet of the sheet having contact plates is peeled, and the sheet having contact plates from which the peel sheet has been peeled is stuck onto the circuit board on which plural fixed contacts are disposed, by an adhesive layer of the spacer sheet so that the contact plates are opposite to the fixed contacts. Therefore, a switch device having a simple construction and employing a sheet having contact plates can be easily formed.

What is claimed is:

1. A sheet having contact plates, comprising:

a strip-shaped peel sheet that is peeled while being fed for use, the peel sheet being peeled off from a downstream end toward an upstream end;

a spacer sheet stuck onto the peel sheet via an adhesive layer;

an upper face sheet stuck onto an upper face of the spacer sheet via an adhesive layer; and contact plates stuck to the upper face sheet, wherein the peel sheet and the spacer sheet are provided with penetration holes through which the contact plates can penetrate, and coupling grooves by which adjacent penetration holes are coupled in a direction crossing a feed direction of the peel sheet, each of the coupling grooves having an upstream edge and a downstream edge where the upstream edge is positioned upstream with respect to the downstream edge, and wherein the coupling grooves are displaced toward the upstream end in the feed direction with respect to a center of each of the adjacent penetration holes so that there are no upstream edges within a plane of the spacer sheet, protruding toward the downstream end in the feed direction.

2. The sheet having contact plates according to claim 1, wherein the coupling grooves extend linearly or curvedly in a direction crossing a direction alone which guide holes for feeding the peel sheet are provided.

3. The sheet having contact plates according to claim 1, wherein the spacer sheet and the upper face sheet are formed rectangularly and are mounted so that short sides of the rectangles are in the feed direction of the strip-shaped peel sheet, and wherein the penetration holes disposed at a side of a long side of the spacer sheet are coupled by the coupling grooves.

4. The sheet having contact plates according to claim 3, wherein the peel sheet and the spacer sheet have second coupling grooves coupling the penetration holes along the short side of the spacer sheet.

5. A switch device comprising:

a sheet having contact plates according to claim 1; and a circuit board on which plural fixed contacts are disposed, wherein a peel sheet of the sheet having contact plates is peeled, and the sheet having the contact plates from which the peel sheet has been peeled is stuck onto the circuit board on which plural fixed contacts are disposed, by an adhesive layer of the spacer sheet so that the contact plates are opposite to the fixed contacts.

6. The switch device according to claim 5, wherein, in the sheet having contact plates, one side of the coupling grooves continues linearly or curvedly.

* * * * *